US005178937A

United States Patent [19]

Janssen et al.

[11] Patent Number: 5,178,937

[45] Date of Patent: Jan. 12, 1993

[54] BELT FOR PAPERMAKING MACHINES

[75] Inventors: Eberhard Janssen, Dueren-Echtz; Wolfgang Schaefer, Dueren; Hans-Peter Richter, Langerwehe, all of Fed. Rep. of Germany

[73] Assignee: Thomas Josef Heimbach GmbH & Co., Dueren, Fed. Rep. of Germany

[21] Appl. No.: 517,195

[22] Filed: May 1, 1990

[30] Foreign Application Priority Data

May 2, 1989 [DE] Fed. Rep. of Germany ..... 3914534

[51] Int. Cl.[5] ..... D03D 13/00

[52] U.S. Cl. ..... 428/222; 139/383 AA; 428/131; 428/132; 428/133; 428/138; 428/192; 428/223; 428/457

[58] Field of Search ..... 428/222, 223, 131, 132, 428/133, 138, 192, 457; 162/DIG. 1; 139/383 AA

[56] References Cited

U.S. PATENT DOCUMENTS

| | | | |
|---|---|---|---|
| 4,238,287 | 12/1980 | Gill | 162/358 |
| 4,552,620 | 2/1985 | Adams | 162/358 |
| 4,559,258 | 12/1985 | Kiuchi | 428/156 |
| 4,564,551 | 1/1986 | Best | 428/257 |
| 4,948,658 | 8/1990 | Halker | 428/234 |

FOREIGN PATENT DOCUMENTS

| | | |
|---|---|---|
| 0052350 | 1/1982 | European Pat. Off. . |
| 0098502 | 1/1983 | European Pat. Off. . |
| 0138797 | 4/1985 | European Pat. Off. . |
| 0185108 | 6/1986 | European Pat. Off. . |
| 3231039 | 3/1983 | Fed. Rep. of Germany . |
| 3235468 | 5/1983 | Fed. Rep. of Germany . |
| 8319684 | 5/1984 | Fed. Rep. of Germany . |
| 3318984 | 11/1984 | Fed. Rep. of Germany . |

*Primary Examiner*—James J. Bell

*Attorney, Agent, or Firm*—Joseph W. Berenato, III

[57] ABSTRACT

A papermaking machine belt comprising a flexible belt-layer impermeable to liquids which is partly integrated with a support track with cavities.

20 Claims, 2 Drawing Sheets

BELT FOR PAPERMAKING MACHINES

The invention concerns a belt for papermaking machines, in particular for wet-pressing with an extended compression slit, comprising a flexible belt-layer impermeable to liquids which is smooth on the back side and in the front side of which has been integrated if only partly a support track with cavities, for instance a fabric, a knit or a wire-link belt.

In the wet-pressing operations of papermaking machines, a substantial part of the residual liquid in the paper web is squeezed out between compression rollers forming a compression slit. The web is guided through the compression slit using a revolving wet felt, the liquid being squeezed out in the compression slit from the web into the wet felt then being drained.

Recently wet presses with extended compression slits have been developed, the so-called "shoe presses", wherein the paper web is exposed over a longer path and hence over a longer time to high compression and as result it exits the wet press at a lower moisture content. In order to guide the web and at least on wet felt through such an extended compression slit, special belts are used, which comprise a flexible layer impermeable to liquids, said layer being smooth on its back side. By means of this smooth back side they move over a hydraulically loaded press shoe forcing the belt toward an opposite compression roller. The paper web to be dehydrated is made to pass between that compression roller and the belt and is accompanied at least on one side by a co-moving wet felt draining the pressed-out water.

Such belts undergo high stresses in the compression slit both longitudinally and transversely and are exposed on both sides to more than trivial abrasion. It has been proposed to solve the former problem by integrating completely a fabric as a support track into the belt layer (see German Offenlegungsschriften 32 31 039; 33 18 984 and U.S. Pat. No. 4,559,258). However the practical embodiments of those belts have failed the test of practice.

In order to improve the water drainage from the front side of the belts, that is from the side facing the paper web and resting against a co-moving wet felt, the front side has been textured. For that purpose belts have been developed on the front side of which support tracks have been integrated but only partly, that is, they partly project above the belt layer. In this manner cavities and ducts have been created for water drainage. Multi-ply fabrics have been proposed as support tracks (German patent 32 35 468; European patent documents 0 098 502 and 0 138 797; German Gebrauchsmuster 83 19 684.6 and European Offenlegungsschrift 0 185 108). In lieu of fabrics as the support tracks, wire-link belts or warp-knits have been suggested, resp. in the European patent 0 098 502 and the European Offenlegungsschrift 0 290 653. As regards the embodiment as a belt of wire links, it was suggested to array longitudinally the mutually linked wire spirals and to insert additionally monofilaments and/or multifilaments into these wire spirals to absorb the longitudinal forces (European patent 0 098 502). Appropriately they should be integrated into the belt layer to improve belt stability and also the fixation of the wire spirals in the belt layer.

Where the belts in the form of support tracks did comprise fabrics, partly integrated into the belt layer, it has been suggested furthermore to form the outwardly projecting parts of the fabric into a wear layer and to form the part of the fabric integrated inside the belt layer into a traction-absorbing base layer (German Gebrauchsmuster 83 19 684.6). Moreover it is part of the state of the art regarding such belts to make part of the lengthwise threads of the fabric forming the support track from a material which is highly dimensionally stable in the longitudinal direction and to make the other part of the longitudinal threads and also the cross threads from a highly wear-resistant material (European patent 0 185 108) Improved wear resistance, pressure distribution, longitudinal stability and rolling-resistance supposedly are thus achieved.

Experiment has shown that the bond between the support track and the belt layer is much jeopardized on account of high pressure and fulling stresses in the region of the front and back sides when the support track enters the belt layer too deeply. On the other hand the support track very easily is torn out of the belt layer if integrated into it only shallowly. Heretofore an adequate compromise has proven impossible or lacking sufficient reproducibility.

The object of the invention is to so design a belt of the initially cited species that the bond between the belt layer and support track shall not be jeopardized when exposed to pressure and fulling stresses and that nevertheless high resistance shall exist against the support track being torn out of the belt layer.

This problem is solved by the following features of the invention:

(a) At least one additional thread is integrated into the belt layer, (b) The additional thread(s) extend(s) in zig-zag manner progressively over the direction of advance of the belt, (c) As regards the additional thread(s), the thread segments outside the support track alternate with thread segments passing through the support track.

According to the invention, the belt contains at least one additional thread in its belt layer, said thread advancing over the entire length of the belt but not in a straight line, rather in zig-zag manner, whereby its individual thread segments between the reversal points extend essentially transversely to the direction of advance of the belt. The additional thread passes in part in the region between the support track and the back side of the belt and partly through the support track, that is it is laced into the support track. Thereby extreme resistance of the support track against being torn out is achieved without it requiring being deeply integrated into the belt layer This makes it possible to optimally match the depth of penetration of the support track into the belt layer to the pressure and fulling stresses without regard to the resistance to tear-out. In addition, the belt evinces improved strength in the transverse direction, in particular improved resistance against tensional and fulling stresses. Such stresses arise especially at the side boundaries of the press shoe and may lead to bulges in the belt.

The invention also provides that the thread segments outside the support track shall be spaced from it because thereby the resistance to tear-out is enhanced.

Further, the additional thread(s) or at least one of these shall be coiled and shall reverse directions between two thread segments. This means that one thread segment shall be outside the support track and following reversal of direction shall pass through the support track and following another reversal of direction shall again be outside this support track.

Appropriately the additional thread or at least one of the additional threads shall extend between the belt edges. The purpose is to make sure that the particular additional thread shall not project beyond the support track edge, rather that the reversal of direction shall take place inside the lateral boundaries of the support track.

In a manner known from the state of the art, applicable materials for the support track are fabrics, especially of several plies, knits and especially belts of wire links. In the latter case those wire link belts are preferred which consist of wire spirals extending transversely to the direction of advance of the belt because being easily connected by a coupling wire at the seam in the case of an endless belt. Use of such a wire-link belt suggests that the additional thread(s) shall always pass by means of one thread segment through one wire spiral and, by means of the next thread segment and following reversal of direction, above the next wire spiral.

The tear-out strength of the support track can also be improved by longitudinal threads passing outside the support track and between the support track and the paths of the additional threads outside the support track integrated into the belt layer. There results, outside the support track but inside the belt layer, a structure of crossed threads not linked to each other but tied by the additional thread(s) to the support track and thereby further improving the adhesion of the support track to the belt layer. In addition, the longitudinal threads improve longitudinal dimensional stability and fulling resistance in this direction, especially when—as shall be proposed below—the longitudinal threads are connected by their ends in traction-resistant manner, that is when they close the loop in the direction of advance of the belt. A belt is then made which meets especially optimally the stresses incurred in wet pressing with extended compression slit, most of all as regards the tensile strength in the longitudinal and transverse directions, the resistance to fulling and the tear-out strength.

The connection between the longitudinal threads and the support track also can be improved by the longitudinal threads being linked to the support at regular intervals. Moreover it is feasible to connect the longitudinal threads to the addition thread(s) at their crossing points.

The additional presence of longitudinal threads furthermore provides greater freedom of selection of the support track. Illustratively the longitudinal threads may be made of especially traction-resistant materials such as polyester or aramide fibers or filaments, and the support track may consist of especially wear-proof materials such as polyamides. Thereby that part of the support track projecting from the belt layer is especially well protected against wear. Because such plastics with high wear-resistance frequently lack good tensile strength or elongate easily, their applicability to support tracks was restricted or impossible entirely. The especially traction-resistant longitudinal threads relieve the support track in that materials evincing on one hand less tensile strength but on the other hand other advantages can be used for the support track.

The invention is elucidated in the drawing by means of illustrative embodiments.

Figure 1:
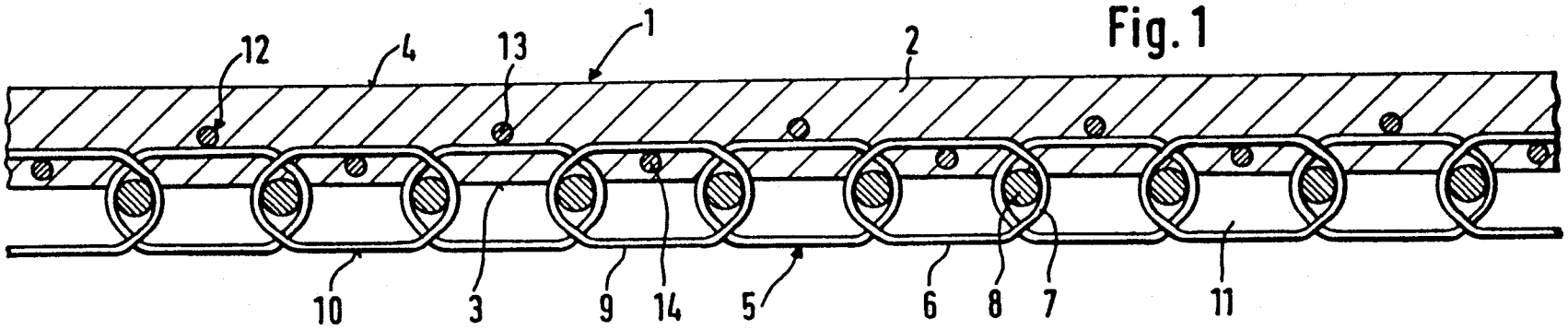
FIG. 1 is a longitudinal section of a belt of the invention.

The belt 1 shown in FIG. 1 comprises a belt layer 2 with front side 3 and back side 4. The back side 4 is ground smooth. In the due application in the wet press of a papermaking machine, this back side 4 when in the compression slit moves past a pressure shoe present therein.

A wire-link belt (5) serving as a support track is partly integrated into the front side 3 of the belt layer 2. Such wire-link belts 5 are known especially where dry belts are used in the drying part of papermaking machines. They consist of a plurality of wire spirals transverse to the direction of advance of the belt 1 and illustratively denoted by 6 which are arranged next to one another in the direction of advance and which overlap by their head arcs illustratively denoted by 7. They are connected in articulating manner in the zone of overlap of their head arcs 7 by means of a coupling wire illustratively denoted by 8 and extending across the width of the wire spirals 6. Their spiral-turns legs—illustratively denoted by 9—between two head arcs 7 essentially are straight so that an essentially plane rest surface 10 is achieved at the free side of the wire-link belt 5. For due application of the belt 1, a wet felt abuts this rest surface 10. The paper web to be dehydrated is borne on the other side of the wet felt.

As shown by FIG. 1 the wire-link belt 5 is integrated only by one third into the belt layer 2, that is, only as far as the coupling wires 8. As a result large cavities 11 are created within the external parts of the wire spirals 6 and these cavities can absorb water from the paper web during compression and hence shall assure rapid drainage of this water. To prevent that the wire-link belt 5 nevertheless shall not be torn too easily out of the belt layer 2, an addition thread 12 passes through the belt layer 2, namely in alternation once along a thread segment illustratively denoted 13 outside a wire spiral, that is between the wire-link belt 5 and the back side 4, and once along a thread segment illustratively denoted 14 inside an adjacent wire spiral 6.

Figure 3:
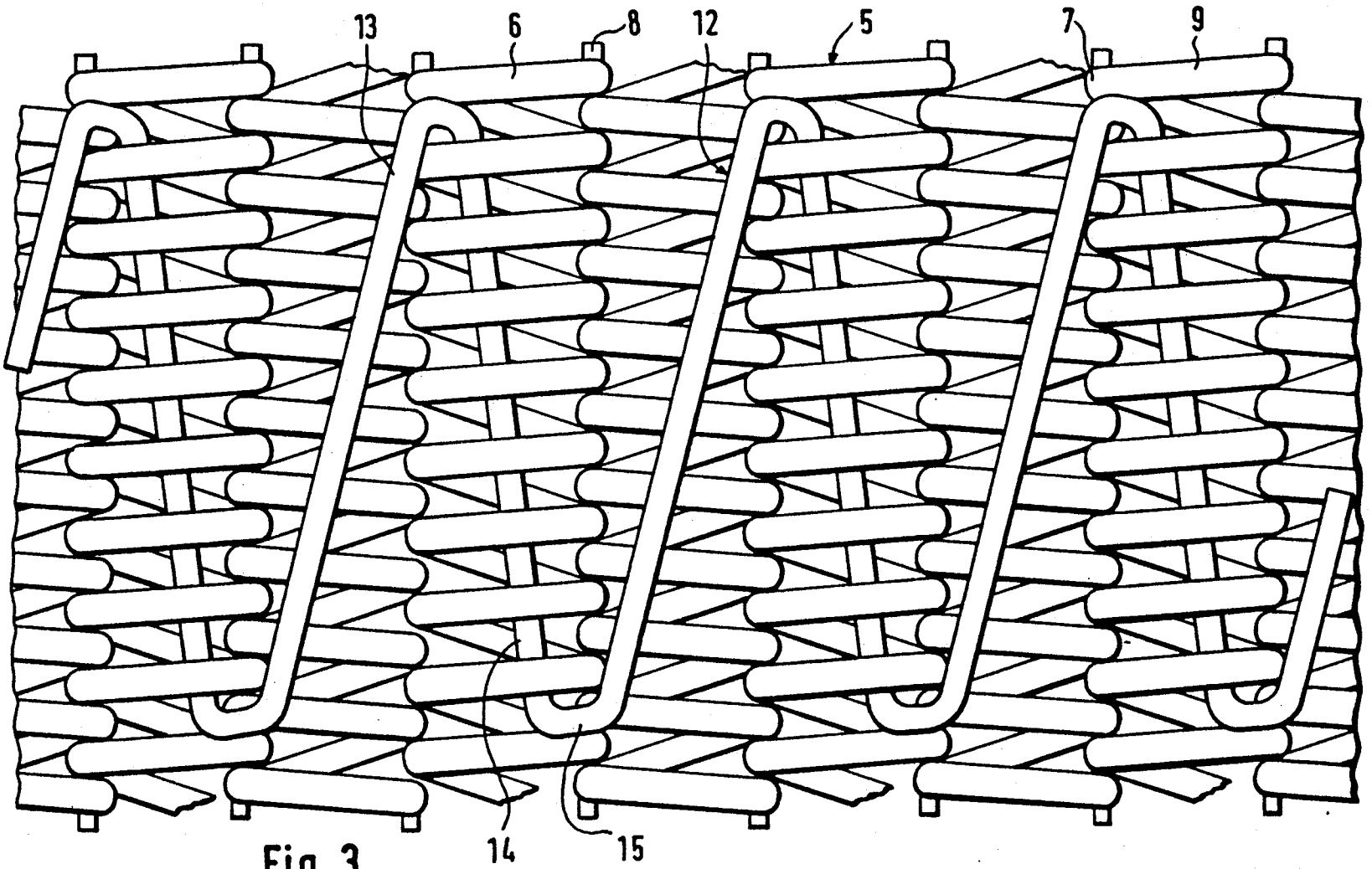
FIG. 3 is a topview of the support track without the belt layer of the belt of FIG. 1.

FIG. 3 shows even more clearly the path of the addition thread 12, the wire-link belt 5 being represented with the addition thread 12 before the belt layer 2 is deposited, ie without this layer. It is clear that the addition thread 12 passes in zig-zag manner, in this instance even like a coil between the edges of the wire-link belt 5 and to-and-fro, once through a wire spiral 6 and following reversal of direction over the particular adjacent wire spiral 6. The reversal points of the addition thread 12 are illustratively denoted by 15 and are so selected that the addition thread 12 exits ahead of the last turn of the wire spirals 6 or enters same. It is obvious that also several addition threads 12 can be connected with the wire-link belt 5 in the manner shown, for instance also in such a way that a second addition thread always passes inside the wire spirals 6 where the first addition thread 1 is present outside that particular wire spiral 6, and vice-versa.

Figure 2:
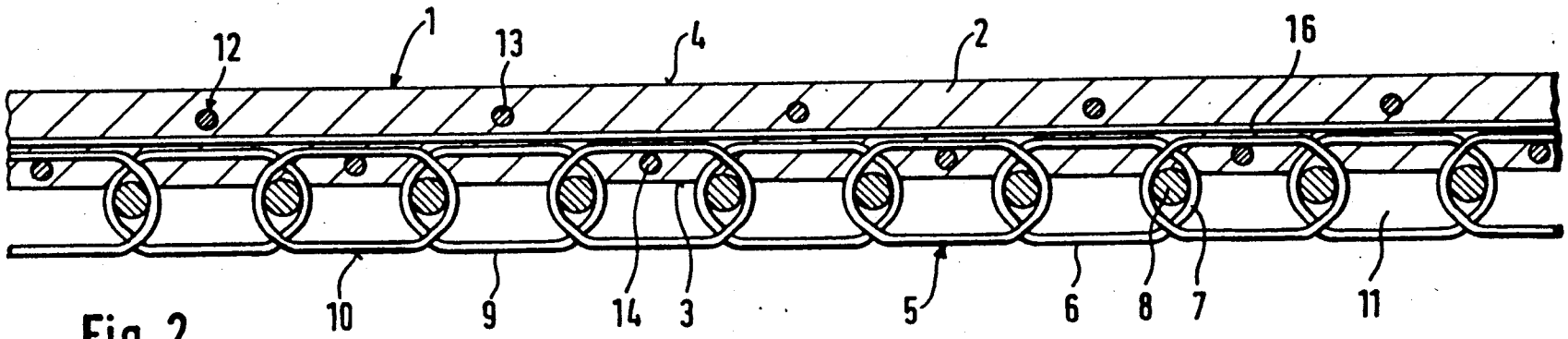
FIG. 2 is a longitudinal section of another belt of the invention.

The illustrative embodiment of a belt 1 shown in FIG. 2 agrees with that of FIG. 1 with one exception, so that the same components are denoted by the same reference numerals, whereby to that extent also the previous description shall serve. The exception is that several mutually parallel longitudinal threads illustratively denoted by 16 and extending in the direction of advance have been integrated into the belt layer 2. These longitudinal threads 16 pass inside the belt layer 2 between the wire-link belt 5 and the thread segments 13 of the addition thread 12 that ar outside the wire spirals 6. In this manner a structure of crossed threads not linked to each other is achieved and thereby the tear-out resistance of the wire-link belt 5 has been improved further.

The longitudinal threads 16 are connected together in traction-resistant manner at their ends herein not shown in further detail, so that they can also absorb longitudinal forces. Preferably they consist of an especially tensionally strong material, illustratively an aromatic aramide or even steel. This makes it possible to employ less traction-resistant but on the other hand highly wear-proof material for the wire spirals 6 of the wire-link belt 5, illustratively polyamides or the like, and thereby to keep slight the abrasion of the support surface 10.

Depending on need, the longitudinal threads 16 and/or the addition threads 6 may be yarns, twists or monofilaments or multifilaments. Applicable materials are polyesters such as polybutyleneterephthalate or polyethyleneterephthalate and its copolymers, polyamides, polyetherketone, polyetheretherketone, polyphenylene sulfide, polypropylene, polyacrylonitride or also carbon or graphite.

The wire spirals 6 also may be designed in the manner described in the German Gebrauchsmusters 86 23 879.5 and 87 06 893.1.

We claim:

1. A papermaking machine belt, in particular for use in wet pressing and the extended compression slit, the belt comprising:

(a) a flexible, liquid impermeable belt layer having first and second sides, at least one of said sides being smooth;

(b) a support track integrated into said layer and having a portion extending outwardly beyond one of said sides for providing a plurality of drainage channels; and (c) at least a first addition thread wholly integrated into said layer and progressing therealong in zigzag manner relative to the direction of advance of said layer, said thread having first and second alternating segments with said first segments disposed within said track and said second segments outside said track.

2. The belt of claim 1, wherein:

(a) said second segments are spaced from said track.

3. The belt of claim 1, wherein:

(a) said addition thread achieves a coiled course, and there being a direction reversal between each of said first and second segments.

4. The belt of claim 1, wherein:

(a) said addition thread extends between opposite edges of said layer.

5. The belt of claim 1, wherein:

(a) said addition thread does not project beyond the lateral edges of said track.

6. The belt of claim 1, wherein said support track includes:

(a) a wire link belt comprising a plurality of interconnected wire spirals extending parallel to the direction of advance of said layer so that said channels extend transverse thereto.

7. The belt of claim 6, wherein:

(a) said spirals arrayed in a plurality of rows, and each of said first segments extending through at least some of the spirals of one row and each of the second segments outside of the spirals of the immediately adjacent and subsequent rows.

8. The belt of claim 7, wherein:

(a) a direction reversal connects said first segments with said second segments.

9. The belt of claim 1, further comprising:

(a) a plurality of longitudinal threads disposed between said track and the other one of said sides.

10. The belt of claim 9, wherein:

(a) said longitudinal threads consist of a material having a tensile strength exceeding the tensile strength of the material of which said support track consists.

11. The belt of claim 10, wherein:

(a) said support track consists of a material which is more wear-resistant than the material of which said longitudinal threads consist.

12. The belt of claim 1, wherein:

(a) the other one of said sides is smooth.

13. A belt for wet pressing and the like in a papermaking machine, comprising:

(a) a flexible, liquid impermeable belt layer having a first smooth side and an opposite second side;

(b) a support track comprising a plurality of wire spirals arrayed into a series of rows, each row extending transverse to the direction of advance of said layer and each spiral of each row having a first portion disposed within said layer and a second portion extending outwardly beyond said second side for therewith forming a plurality of drainage channels; and (c) an addition thread wholly integrated into said layer and lacing said track thereto, said thread having first and second alternating segments with one of said first and second segments passing through at least some of the spirals of some of said rows and the other of said first and second segments being removed from said spirals.

14. The belt of claim 13, wherein:

(a) each of said first segments passes through the spirals of every other one of said rows.

15. The belt of claim 14, wherein:

(a) said addition thread does not extend beyond the lateral edges of said track.

16. The belt of claim 13, wherein:

(a) the other ones of said first and second segments are spaced from said track.

17. The belt of claim 16, wherein:

(a) a longitudinal thread is disposed in said layer between said track and said other ones of said first and second segments.

18. The belt of claim 13, wherein:

(a) said rows are interconnected, and each spiral of each row is connected to a spiral of each of the adjacent rows.

19. The belt of claim 18, wherein:

(a) a coupling wire extends between the spirals of immediately adjacent rows for coupling said rows together.

20. The belt of claim 13, wherein:

(a) a direction reversal is formed in said thread between each of said first and second segments, and said direction reversals are disposed inwardly relative to the lateral edges of said track.

* * * * *